US008720244B2

(12) United States Patent
Takahama et al.

(10) Patent No.: US 8,720,244 B2
(45) Date of Patent: May 13, 2014

(54) METHOD OF SUPPLYING LUBRICATION OIL IN COLD ROLLING

(75) Inventors: Yoshiki Takahama, Futtsu (JP); Toshiyuki Shiraishi, Futtsu (JP); Shigeru Ogawa, Futtsu (JP); Luc Vanel, Ogy (FR); Guy Hauret, Fos-Sur-Mer (FR); Maxime Laugier, Montigny-les-Metz (FR); Pascal Masson, Metz (FR)

(73) Assignees: Nippon Steel & Sumitomo Metal Corporation, Tokyo (JP); Arcelor France, Saint Denis (FR)

( * ) Notice: Subject to any disclaimer, the term of this patent is extended or adjusted under 35 U.S.C. 154(b) by 1524 days.

(21) Appl. No.: 11/791,354

(22) PCT Filed: Nov. 17, 2005

(86) PCT No.: PCT/JP2005/021495

§ 371 (c)(1),
(2), (4) Date: Oct. 29, 2007

(87) PCT Pub. No.: WO2006/054780

PCT Pub. Date: May 26, 2006

(65) Prior Publication Data

US 2008/0087066 A1 Apr. 17, 2008

(30) Foreign Application Priority Data

Nov. 22, 2004 (JP) ..... 2004-337305

(51) Int. Cl.
*B21B 45/02* (2006.01)
*B21B 28/00* (2006.01)

(52) U.S. Cl.
USPC ..... 72/41; 72/236

(58) Field of Classification Search
USPC ..... 72/39, 41–45, 201, 236; 184/6.21, 6.22, 184/104.1
See application file for complete search history.

(56) References Cited

U.S. PATENT DOCUMENTS

| | | | | |
|---|---|---|---|---|
| 3,802,237 | A * | 4/1974 | Albensi et al. | 72/236 |
| 5,090,225 | A * | 2/1992 | Schimion | 72/45 |
| 5,224,051 | A * | 6/1993 | Johnson | 72/42 |
| 5,282,376 | A * | 2/1994 | Steele et al. | 72/43 |
| 6,269,668 | B1 | 8/2001 | Shiraishi et al. | |

FOREIGN PATENT DOCUMENTS

| | | |
|---|---|---|
| EP | 0 908 248 | 4/1999 |
| JP | 56-033115 | 4/1981 |
| JP | 57-202905 | 12/1982 |
| JP | 59-033023 | 2/1984 |

(Continued)

OTHER PUBLICATIONS

Supplementary European Search Report dated Aug. 1, 2008 issued in corresponding European Application No. 05 80 9725.

(Continued)

*Primary Examiner* — Teresa M Ekiert
(74) *Attorney, Agent, or Firm* — Kenyon & Kenyon LLP

(57) ABSTRACT

The present invention provides a method for supplying lubricant to various kinds of steel sheets with different qualities in cold rolling without any restrictions, such as lubricant supplying apparatus or lubrication conditions. This method comprises storing two or more kinds of lubricant such as A and B, having different compositions, selecting one lubricant or a mixture lubricant of the above A and B in accordance with the friction coefficient between the steel sheet to be cold rolled and a work-rolls, and supplying an emulsion comprising a mixture of the lubricant A and/or B and heated water.

7 Claims, 6 Drawing Sheets

(56) References Cited

FOREIGN PATENT DOCUMENTS

| | | |
|---|---|---|
| JP | 59-199109 | 11/1984 |
| JP | 08-155510 | 6/1996 |
| JP | 09-248613 | 9/1997 |
| JP | 10-298586 A | 11/1998 |
| JP | 2000-218305 A | 8/2000 |
| JP | 2000-351002 | 12/2000 |

OTHER PUBLICATIONS

Korean Patent issued Aug. 4, 2008 in corresponding Korean Application No. 7011626/2007.

* cited by examiner

METHOD OF SUPPLYING LUBRICATION OIL IN COLD ROLLING

TECHNICAL FIELD

The present invention relates to a method of supplying lubrication oil for supplying lubrication oil to an inlet side of a rolling stand in cold rolling of a metal sheet.

BACKGROUND ART

For example, in cold rolling of steel sheet, from the viewpoint of the stabilization of the rolling operation, shape and surface quality of the product, prevention of seizure, roll lifetime, etc., it is necessary to maintain the friction coefficient between the rolled material (steel sheet) and work rolls at a suitable value. To obtain a suitable friction coefficient, a lubrication oil suitable for the grade and dimension of the rolled sheet and the rolling conditions is selected and is fed at the inlet side of the rolling stand to the rolled steel sheet and the rolls. In tandem cold rolling mill, in general, emulsion lubrication is used.

To obtain a suitable friction coefficient, increasing the emulsion supplying rate or emulsion concentration is an effective means for improving the lubricity and reducing the friction coefficient, but this invites an increase in cost. Further, there is a limit to the increase in the emulsion supplying rate or emulsion concentration in the current state due to limitations in facilities. As the limitation in facilities, for example, in the case of high concentration emulsion, sometimes the pipes become clogged or the capacity of an agitator in the tank impairs the homogeneity of the high concentration emulsion. Further, the upper limit of the emulsion supplying rate is determined by the pump capacity.

Recently, high tensile steel, TRIP steel, and other materials called hard to produce materials are being rolled in an increasing trend. With hard to produce materials, the rolling load becomes higher, so there is a need to reduce the friction coefficient and reduce the rolling load at the front-end stands (e.g. 1st and/or 2nd stand) in the tandem cold rolling mill and to prevent seizure by reducing the friction coefficient and suppressing the friction heat in the rear-end stands which rolling rate becomes higher. That is, there is a need to reduce the friction coefficient in the entire rolling rate region compared with a mild carbon steel when rolling a hard to produce steel sheet.

If schematically showing the case of use of a lubrication oil A where the friction coefficient becomes within the allowable range with respect to a mild steel, the result becomes as shown in FIG. 9. The lower limit of the allowable range of the friction coefficient is the limit at which the friction coefficient cannot be lowered further due to the performance of the lubrication oil, restrictive conditions of the facility, etc. explained above. Further, slip occurs even if there are no problems in restrictions of the facilities, so sometimes the friction coefficient cannot be lowered further. On the other hand, the upper limit is determined by the seizure resistance in the boundary friction region of the lubrication oil. From experience with operations up to now, the upper limit has been determined. The rolling conditions are set so that the friction coefficient becomes somewhat smaller than that. Up until now, mostly mild steel had been rolled, so lubrication oil A alone was able to handle it. However, as clear from FIG. 9, to roll super high tensile steel with a tensile strength of for example 1270 MPa or more, lubrication oil A alone was not sufficient to obtain a suitable friction coefficient.

To solve this problem, the method of using a plurality of types of lubrication oil may be considered. For example, there is the method of preparing a low concentration and a high concentration lubrication oil by the same lubrication oil and supplying it to different supplying locations (for example, see Japanese Patent Publication (A) No. 59-33023) or the method of selective use in accordance with the steel sheet thickness (for example, see Japanese Patent Publication (A) No. 8-155510). However, as with these methods, even if using the same lubrication oil and changing the concentration, if considering the limitations in facilities of the rolling mill or cost, it is difficult to handle the current plurality of rolled steel sheets.

Further, in another method of supplying lubrication oil, the method of preparing four tanks, prescribing three different types of lubrication oil, and selectively using them in accordance with the steel sheet thickness has been proposed (for example, see Japanese Patent Publication (A) No. 59-199109). This method uses four tanks and three types of lubrication oil and a detergent solution, but there is no description of the film thickness or the friction coefficient. Further, the method of classification of the grade and lubrication oil is also rough. There are the problems that it is difficult to control lubrication sufficiently to meet all the strict requirements for surface quality in recent years or all the small lots of various types of rolled steel sheets and fine control is difficult.

Further, there is also the method of changing the mixing ratio of at least two types of lubrication oil to change the composition of the lubrication oil in accordance with the quality characteristics required from the hot rolled steel strip for each hot rolled steel strip and supplying the rolling oil comprised of the lubrication oil and water to at least one rolling stand (for example, see Japanese Patent Publication (A) No. 2000-351002). With this method, the lubrication oil supplying rate is controlled in accordance with only the quality characteristics required, so fine control was not possible.

DISCLOSURE OF INVENTION

The present invention has as its object to provide a method of supplying lubrication oil able to handle a plurality of grades of metal (steel) sheets without being limited by the lubrication oil apparatus or lubrication control system in cold rolling of a metal (steel) sheet.

A method of supplying lubrication oil of a first aspect of invention provides a method of supplying lubrication oil for supplying an emulsion of a lubrication oil and heated water mixed together to an inlet side of rolling stands of rolling mill in cold rolling of a steel sheet, comprising storing two or more types of lubrication oils of different compositions in separate tanks, selecting one of the stored lubrication oils in accordance with a friction coefficient between the rolled steel sheet and work rolls, and supplying an emulsion comprised of the selected lubrication oil and heated water mixed together to an inlet side of the rolling mill.

A method of supplying lubrication oil of a second aspect of invention provides a method of supplying lubrication oil for supplying an emulsion comprised of a lubrication oil and heated water mixed together to an inlet side of a rolling stand in cold rolling of a steel sheet, comprising storing the two or more types of lubrication oil of different compositions and at least one type of lubrication oil and at least one type of additive in separate tanks, mixing two or more types of lubrication oil selected from the stored lubrication oils in accordance with the friction coefficient between the rolled steel sheet and work rolls, mixing at least one selected lubrication oil and at least one selected additive to obtain a mixed oil, and supplying an emulsion comprised of this mixed oil mixed with heated water to an inlet side of a rolling stand.

In the methods of supplying lubrication oil of the first aspect of the invention and the second aspect of the invention, at least one of the lubrication oil may include an additive. Further, the method of supplying lubrication oil of the second aspect of the invention further may further comprise controlling an emulsion lubrication oil supplying rate and/or emulsion concentration in accordance with the rolling rate.

A method of supplying lubrication oil of a third aspect of invention provides a method of supplying lubrication oil for supplying an emulsion comprised of a lubrication oil and heated water mixed together to an inlet side of a rolling stand in cold rolling of a steel sheet, comprising storing two types of lubrication oils of different compositions and the lubrication oils and additives in separate tanks, setting in advance two mixing ratios of a first mixing ratio and second mixing ratio in accordance with the friction coefficient for the two types of lubrication oil or a lubrication oil and additive, supplying a first emulsion produced by the first mixing ratio to the inlet side of the rolling stand, increasing the emulsion supplying rate to reduce the friction coefficient when the estimated friction coefficient during rolling is larger than a target friction coefficient, switching to a second emulsion produced by the second mixing ratio and supplying the second emulsion to the inlet side of the rolling stand when the increase of the emulsion supplying rate reduces the friction coefficient, and switching the second emulsion to the first emulsion to reduce the emulsion supplying rate and supplying the first emulsion to the inlet side of the rolling stand when the estimated friction coefficient during rolling is smaller than the target friction coefficient.

In the method of supplying lubrication oil of the third aspect of the invention, at least one of the lubrication oils may include an additive.

BEST MODE FOR WORKING THE INVENTION

Embodiment of First Aspect of Invention

In cold rolling steel sheet, mild steel and super-high tensile steel are rolled. Two types of lubrication oils of lubrication oil A and lubrication oil B of different compositions are used and are separately stored in two tanks. As the lubrication oil, mineral oil, natural oil, synthetic ester, etc. may be used. Depending on the rolling conditions, these lubrication oils may also have an emulsifying agent, extreme pressure agent, oiliness agent, or other additives added to them in amounts of 1 to 5 vol % or so with respect to the base oil. Further, the lubrication base oil does not have to be limited to two types. More than two types are good in that it increase the degree of freedom of selection. However, if giving the explanation with respect to more than two types, the explanation would become complicated, so for simplification, below the explanation will be given of two types of lubrication oil.

The lubrication oil A and lubrication oil B are fed as an emulsion to an inlet side of a rolling machine and used in the range of application of the lubrication oil. Here the "range of application of the lubrication oil" means a range in which the emulsion of the lubrication oil gives a friction coefficient allowable in terms of rolling operation and quality of product. The range of application of the lubrication oil is determined by the type of the lubrication oil, emulsion supplying rate, and emulsion concentration.

Figure 1:
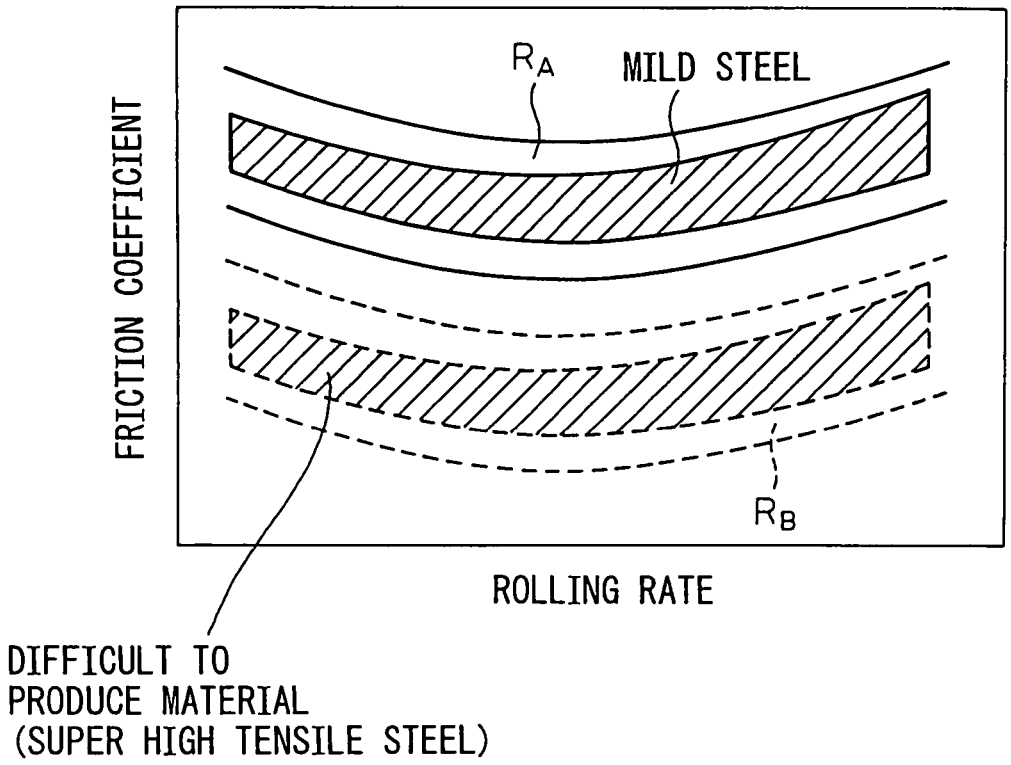
FIG. 1 is a graph showing the relationship between the ranges of application RA and RB of lubrication oils A and B of different compositions and two types of steel (mild steel and super high tensile steel) in one embodiment of the first aspect of the invention.

As shown in FIG. 1, the range of application RA of the lubrication oil A and the range of application RB of the lubrication oil B are mutually independent and do not overlap in any portions. Mild steel is completely covered by the range of application RA, while super high tensile steel is completely covered by the range of application RB. Therefore, the two lubrication oil tanks are switched in accordance with the friction coefficient between the rolled steel sheet and work rolls to select the lubrication oil to be supplied. The relationship between the rolling rate and friction coefficient and range of application of each lubrication oil is found in advance by a test mill or operation records and are stored in a tabular format or by numerical equations in a lubrication control apparatus comprised of for example a computer.

The selected lubrication oil and heated water are mixed and fed as an emulsion to the inlet side of the rolling machine. A suitable value of the mixing ratio of the lubrication oil and heated water is found in advance by a test mill or operation records and set as a standard emulsion concentration in the lubrication control apparatus. The temperature of the heated water is 50 to 90° C. or so.

Figure 2:
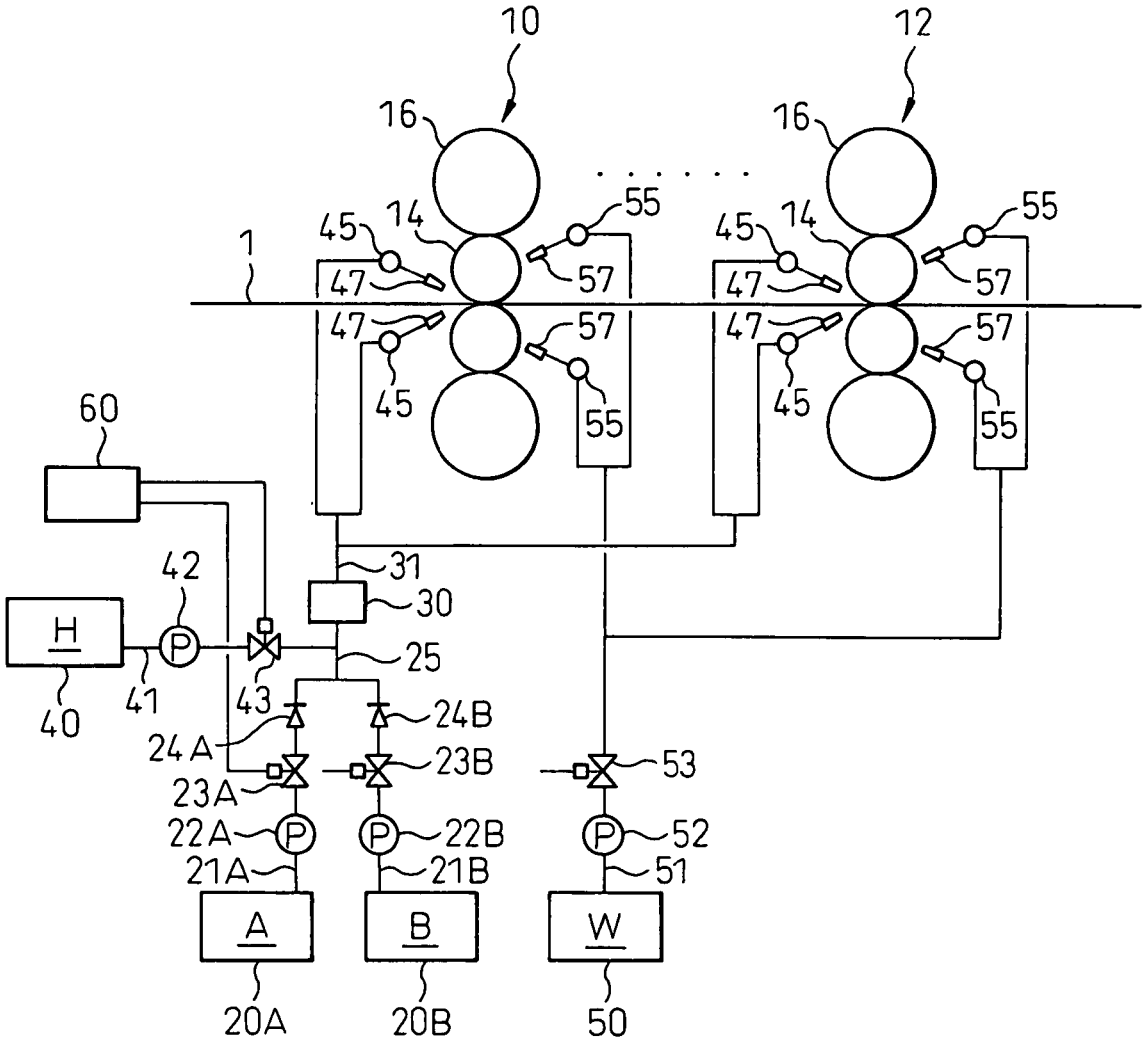
FIG. 2 is a view schematically showing a rolling facility for working the method of the first aspect of the invention.

FIG. 2 shows an example of a cold rolling facility for working the method of supplying lubrication oil of the first aspect of invention. The rolling facility is for example comprised of five stands. FIG. 2 shows only the front-end stand of the rolling stand 10 and the last stand of the rolling stand 12. The rolling machines 10 and 12 are rolling stands which have four rolls, work rolls 14 and backup rolls 16.

The rolling facility is provided with lubrication oil tanks 20A and 20B for storing lubrication oils A and B, a heated water tank 40, and a cooling water tank 50. The lubrication oil tanks 20A and 20B are connected via lubrication oil pipes 21A and 21B to a main pipe 25, while the main pipe 25 is connected to a lubrication oil and heated water mixer 30 comprised of a static mixer. The lubrication oil pipes 21A and 21B have lubrication oil pumps 22A and 22B, lubrication oil flow rate regulating valves 23A and 23B, and check valves 24A and 24B attached to them. Further, the heated water tank 40 is connected through a heated water pipe 41 to which a heated water pump 42 and heated water flow rate regulating valve 43 are attached to the main pipe 25.

The front-end stands of rolling 10 and the rear-end stands of rolling stand 12 have emulsion headers 45 arranged at the inlet sides. The emulsion headers 45 of the front-end stands of rolling stand 10 are provided close to the steel sheet 1 and work rolls 14 and are provided with a plurality of emulsion nozzles 47 along the sheet width direction. The emulsion headers 45 of the higher rolling rate rear-end stands of rolling stand 12 are provided a distance to the upstream side from the roll bite considering the plateout time and are provided with a plurality of emulsion nozzles 47 along the sheet width direction. The distance between the emulsion nozzles 47 and roll bite is about 0.2 to 3 m. The lubrication oil and heated water mixer 30 is connected to the emulsion headers 45 via the emulsion supplying pipes 31.

The rolling stands 10 and 12 are provided at their outlet sides with cooling water headers 55. Each cooling water header 55 is provided with a plurality of cooling nozzles 57 arranged along the sheet width direction. The cooling water tank 50 is connected to a cooling water pipe 51 with a cooling water pump 52 and cooling water flow rate regulating valve 53 attached to it.

The rolling facility is provided with a lubrication control apparatus 60 comprised of a computer. The lubrication control apparatus 60 is set in advance with the emulsion supplying rate, the standard emulsion concentration, etc. Based on these, it outputs operating signals to the lubrication oil flow rate regulating valves 23A and 23B, the heated water flow rate regulating valve 43, etc.

In a rolling facility configured in this way, when the steel sheet 1 is mild steel, the lubrication oil A is sent from the lubrication oil tank 20A through the lubrication oil pipe 21A to the main pipe 25 by the lubrication oil pump 22A. Note that the lubrication oil flow rate regulating valve 23B of the lubrication oil B is closed and the flow rate becomes 0. On the other hand, heated water is sent from the heated water tank 40 through the heated water pipe 41 to the main pipe 25 by the heated water pump 42. The heated water is heated in the heated water tank 40 and for example is held at 65° C. The lubrication oil A and the heated water are mixed at the main pipe 25 and flow into the lubrication oil and heated water mixer 30.

The mixed lubrication oil A and heated water are stirred in the lubrication oil and heated water mixer 30 to produce the emulsion EA of the lubrication oil A. The operating signal from the lubrication control apparatus 60 is used to adjust the flow rates of the lubrication oil flow rate regulating valve 23A and the heated water flow rate regulating valve 43 and adjust to the standard emulsion concentration CA (mixing ratio). The emulsion EA is supplied through the emulsion supplying pipes 31 and emulsion headers 45 from the emulsion nozzles 47 to the inlet sides of the rolling stands. Further, the work rolls 14 are cooled by cooling water sprayed from the cooling water nozzles 57.

In the case of super high tensile steel, the lubrication flow rate regulating valve 23A is closed and the lubrication oil B is supplied from the lubrication oil tank 20B through the lubrication oil pipe 21B to the main pipe 25. The emulsion of the lubrication oil B is produced and supplied to the inlet sides of the rolling stands in the same way as the case of the lubrication oil A.

Embodiment of Second Aspect of Invention

Figure 3:
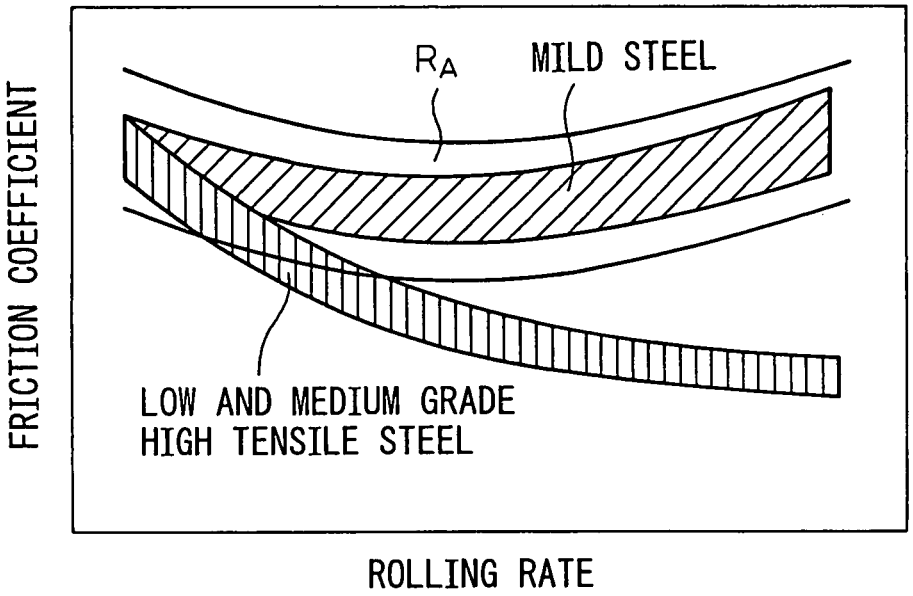
FIG. 3 is a graph showing the relationship between the range of application RA of lubrication oil A and two types of steel (mild steel and low and medium grade high tensile steel).

In current day rolling, the ratio of super high tensile steel is about several %. Almost all of this is low and medium grade high tensile steel and mild steel with a tensile strength of up to 600 MPa. The range of the friction coefficient required in low and medium grade high tensile steel is shown in FIG. 3. In low and medium grade high tensile steel, the increase in weight at the low speed part of the front-end stands in cold tandem rolling mill is smaller than the case of mild steel, so it is sufficient that the friction coefficient of the extent of mild steel be realized. However, if trying to realize high speed rolling, seizure is liable to occur, so it is necessary to reduce the friction coefficient to suppress the generation of heat by friction. In this case, with the lubrication oil A used up to now, the range of friction coefficient required in the speed range of the medium speed or more cannot be satisfied, so at the present, low speed rolling has to be used and high speed rolling cannot be realized.

Figure 4:
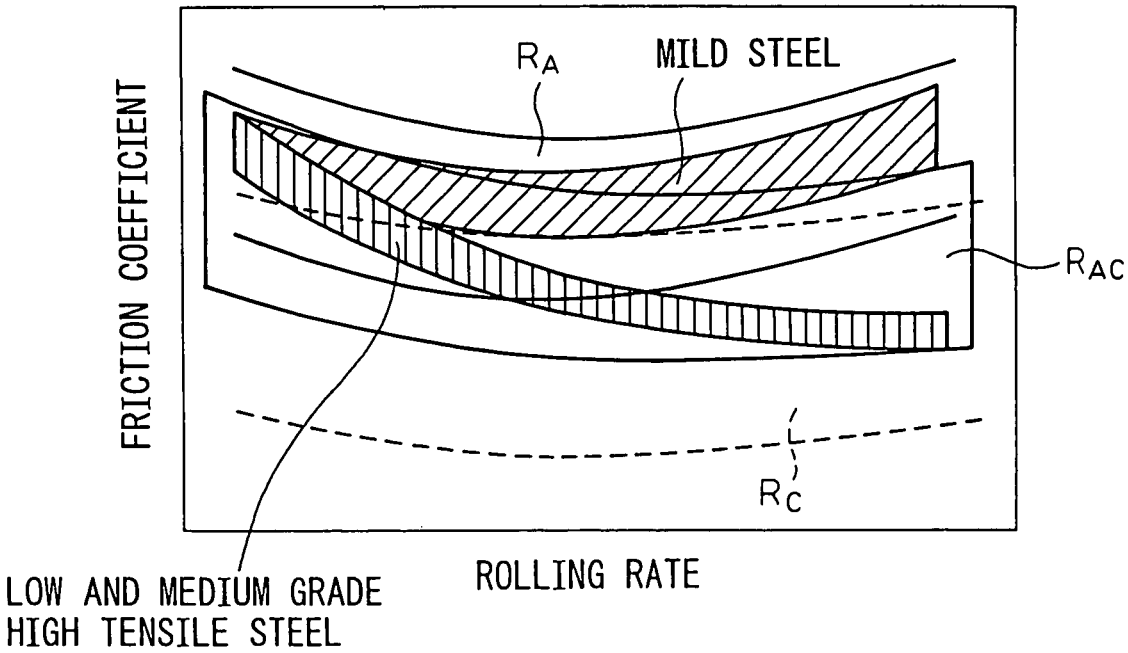
FIG. 4 is a graph showing the relationship between the ranges of application RA and RC of lubrication oils A and C of different compositions and two types of steel (mild steel and low and medium grade high tensile steel) in one embodiment of the second aspect of the invention.

In this embodiment, two types of lubrication oils of different compositions may be mixed to realize low speed rolling and high speed rolling. For example, a lubrication oil C able to obtain a range of friction coefficient as shown in FIG. 4 is used. The lubrication oil C contains large amounts of an extreme pressure, oiliness agent, or other additive compared with a lubrication oil A and is generally expensive. For this reason, the greater the amount of use of the lubrication oil C, the higher the cost incurred. Therefore, the lubrication oil A and the lubrication oil C are mixed and the steel is rolled from the low speed to the high speed by a single mixing ratio by a range of the friction coefficient able to be taken by the lubrication oil A and lubrication oil C.

The inventors discovered that, except in special cases, even if mixing the lubrication oil A and the lubrication oil C, without any chemical reaction being caused, the friction coefficient at the time of mixing becomes between the friction coefficients of the lubrication oil A and the lubrication oil C. As the mixing method, two lubrication oil tanks storing the lubrication oil A and lubrication oil C are prepared, the ratio of supply from the lubrication oil tanks is changed in accordance with the required ratio, and the oils are mixed in the middle of the pipe and agitated by the lubrication oil static mixer to produce a mixed oil. Next, the mixed oil and heated water are mixed and are agitated at the mixed oil and heated water static mixer to obtain an emulsion which is fed to the inlet side of the rolling mill.

In particular, when the range of application of the lubrication oil A and the range of application of the lubrication oil C partially overlap as in FIG. 4, a single mixing ratio can be used to realize lubrication in most cases. Even if the ranges of application of the two are separate, if the two are close enough, it is possible to set one type of mixing ratio. The mixing ratios which can realize the ranges of application and low speed to high speed rolling are found in advance by a test mill. Setting a single type of mixing ratio in advance according to the steel is simple in control. Since the type of steel sheet is stored in the lubrication control apparatus, without having to depend on the operator, it is possible to roll the steel sheet while setting the mixing ratio in accordance with the friction coefficient between the rolled steel sheet and work rolls.

When making the emulsion supplying rate and emulsion concentration the same as the time of use of the lubrication oil A, sometimes, by just making the mixing ratio of the lubrication oil A and lubrication oil C constant, sometimes it is not possible to realize a sufficiently small friction coefficient at the time of for example high speed rolling. At the time of ordinary rolling using the lubrication oil A, in many cases both the emulsion supplying rate and emulsion concentration are set to below the maximum values, so it is possible to change the emulsion supplying rate and emulsion concentration from the values at the time of use of the lubrication oil A. Therefore, it is possible to change the emulsion supplying rate or emulsion concentration in accordance with the rolling rate so as to realize high speed rolling. In general, the factor easy to change in accordance with the rolling rate is the emulsion supplying rate. Therefore, first, the emulsion supplying rate is changed. When the required friction coefficient cannot be obtained even so, adopting the method of changing the emulsion concentration is desirable.

To control the emulsion supplying rate or emulsion concentration, the friction coefficient is measured on line and the measured friction coefficient is made to match the target value by changing the emulsion supplying rate or emulsion concentration or by finding the relationship between the rolling rate and the friction coefficient in advance and controlling the emulsion supplying rate or emulsion concentration in accordance with the rolling rate. Note that when measuring the friction coefficient, there is the possibility of roll wear having an effect. Roll wear is highly correlated to the rolling tonnage, so the relationship between the rolling tonnage and the amount of wear is found in advance and the roll wear is corrected for in control of lubrication according to the rolling rate.

Figure 5:
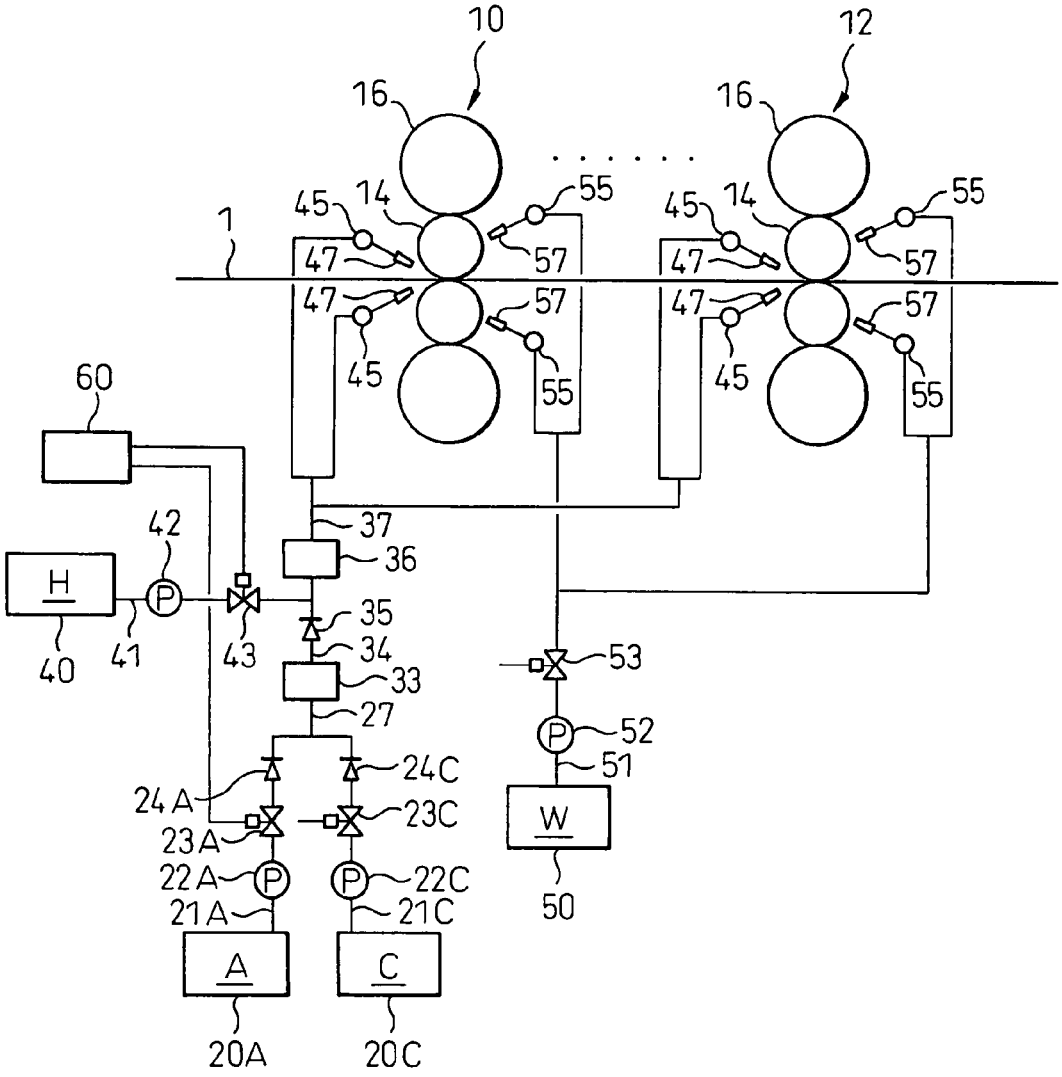
FIG. 5 is a view schematically showing a rolling facility for working the method of the second aspect of the invention.

FIG. 5 shows an example of a cold rolling facility for working the method of supplying lubrication oil of the second aspect of the invention. In FIG. 5, apparatuses and members similar to the rolling mills shown in FIG. 2 are assigned the same reference numerals and detailed explanations are omitted. When the rolled steel sheet is mild steel, the emulsion of the lubrication oil A is supplied to the inlet sides of the rolling mills in the same way as the first aspect of the invention.

In FIG. 5, lubrication oil pipes 21A and 21C from lubrication oil tanks 20A and 20C are connected to a lubrication oil mixing pipe 27. The lubrication oil mixing pipe 27 is connected to a lubrication oil mixer 33, while the lubrication oil mixer 33 is connected through a main pipe 34 to which a check valve 35 is attached to a lubrication oil and heated water mixer 36. The main pipe 34 between the check valve 35 and the lubrication oil and heated water mixer 36 has a heated water pipe 41 connected to it. The lubrication oil and heated water mixer 36 is connected through emulsion supplying pipes 37 to emulsion headers 45.

In the rolling facility configured in this way, when the rolled steel sheet is high tensile steel, in the low speed region where the friction coefficient falls in the range of application RA of the lubrication oil A, lubrication oil A is supplied from the lubrication oil tank 20A through the lubrication oil pipe 21A and mixing pipe 27 to the main pipe 34. In the main pipe 27, the lubrication oil A and the heated water from the heated water tank 40 are mixed. Next, the mixed lubrication oil A and heated water are agitated by the lubrication oil and heated water mixer 36 to produce an emulsion EA of the lubrication oil A. The lubrication oil flow rate regulating valve 23A and the heated water flow rate regulating valve 43 are adjusted in their flow rates to adjust the mixing ratio of the lubrication oil A and heated water. The emulsion EA of the lubrication oil A is fed through the emulsion supplying pipes 37 and emulsion headers 45 from the emulsion nozzles 47 to the inlet sides of the rolling stands 10 and 12.

Figure 6:
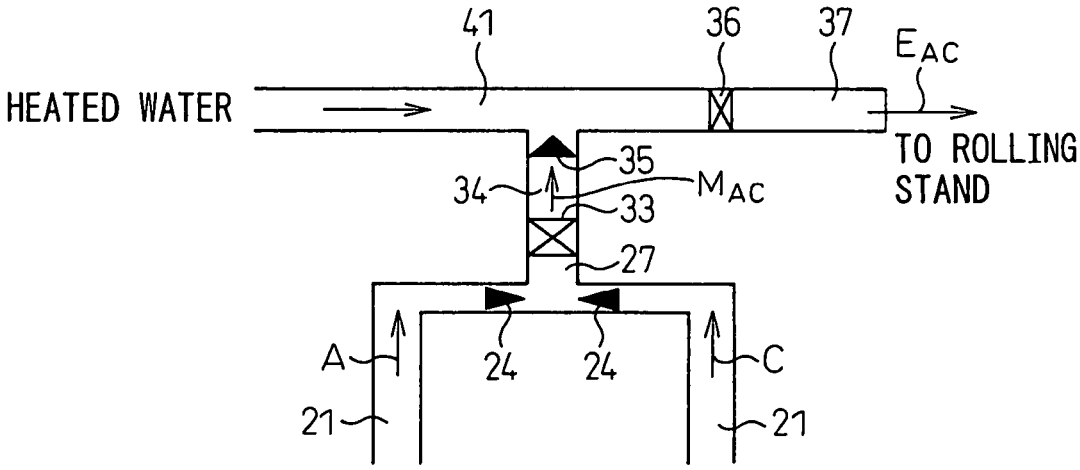
FIG. 6 is a view schematically showing mixing of two types of lubrication oil and mixing of the mixed oil and heated water in the rolling facility of FIG. 5.

In FIG. 4, in the intermediate speed region where the friction coefficient does not fall in the ranges of application RA and RC of the lubrication oil A and lubrication oil C, a mixed oil of the lubrication oil A and lubrication oil C is used. The lubrication oil A is supplied from the lubrication oil tank 20A through the lubrication oil pipe 21A to the mixing pipe 27, of the lubrication oil C is supplied from the lubrication oil tank 20C through the lubrication oil pipe 21C to the mixing pipe 27. As shown in FIG. 6, the lubrication oil A and lubrication oil C are mixed in the mixing pipe 27 and the mixed oil MAC is sent to the main pipe 34. On the other hand, heated water is fed from the heated water tank 40 through the heated water pipe 41 to the main pipe 34 and is mixed with the mixed oil MAC. The mixed oil MAC and heated water are agitated by the lubrication oil and heated water mixer 36 to produce an emulsion EAC of the mixed oil MAC of the lubrication oil A and lubrication oil C. The lubrication oil flow rate regulating valves 23A and 23C and the heated water flow rate regulating valve 43 are adjusted in their flow rates to adjust the mixing ratio of the lubrication oil A and lubrication oil C. The emulsion EAC of the mixed oil MAC is supplied through the emulsion supplying pipes 37 and emulsion headers 45 from the emulsion nozzles 47 to the inlet sides of the rolling stands 10 and 12.

In the high speed region, the friction coefficient completely falls in the range of application RC of the lubrication oil C, so the same procedure is followed as with the low speed region lubrication oil A to produce an emulsion MAC of the lubrication oil C and to supply it to the inlets of the rolling stands 10 and 12.

In this embodiment, the two lubrication oil tanks both store lubrication oil, but the invention is not limited to this. It is also possible to have one tank store lubrication oil, have the other tank store the additive, mix the lubrication oil and additive, and supply an emulsion of the mixed oil. There may also be three or more tanks. For example, when there are four tanks, it is possible to have three tanks store three types of lubrication oil of different compositions and have the remaining tank store the additive or have two tanks store two types of lubrication oil of different compositions and have the other two tanks store two types of additive of different compositions. In this case, three types of lubrication oil may be mixed, three types of lubrication oil and one type of additive may be mixed, two types of lubrication oil and two types of additives may be mixed, or other combinations may be mixed.

Embodiment of Third Aspect of Invention

Figure 7:
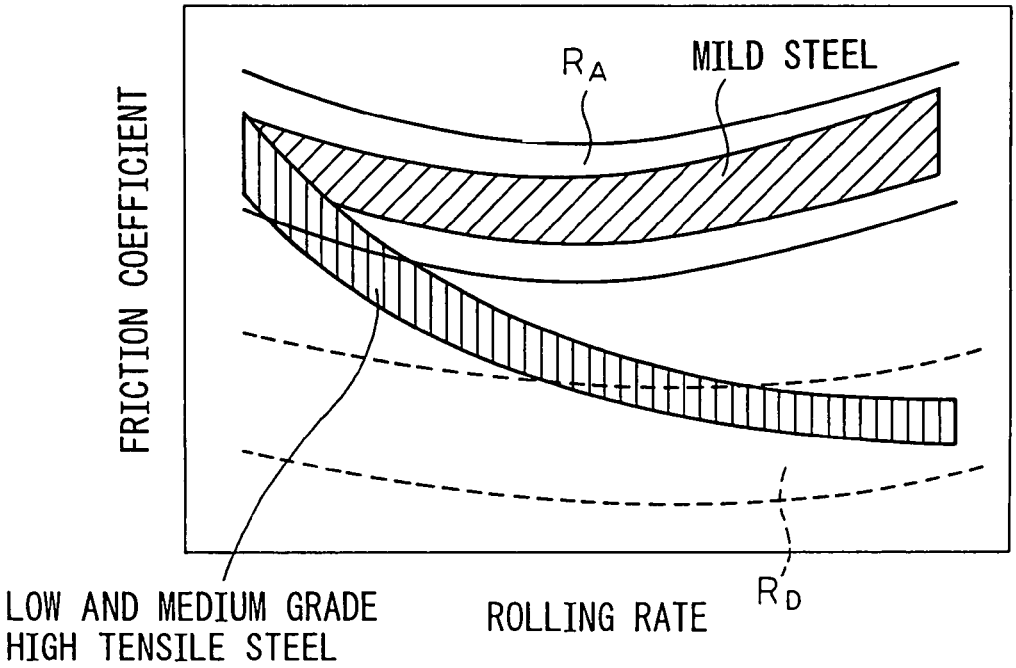
FIG. 7 is a graph showing the relationship between the range of application RA of the lubrication oil A and two types of steel (mild steel and low and medium grade high tensile steel).

Depending on the type of the lubrication oil, as shown by the lubrication oil D shown in FIG. 7, sometimes the range of application RD is far from the range of application RA of the lubrication oil A. In this case, depending on the steel, sometimes a single mixing ratio alone is not enough to realize rolling from the low speed to the high speed.

Figure 8:
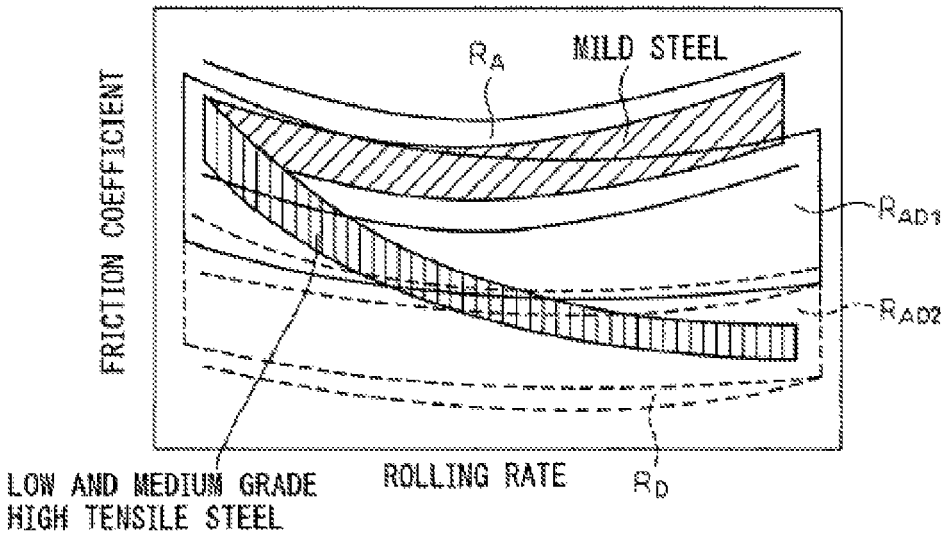
FIG. 8 is a graph showing the relationship between the ranges of application RA and RD of lubrication oils A and D of different compositions and two types of steel (mild steel and low and medium grade high tensile steel) in one embodiment of the third aspect of the invention.
Figure 9:
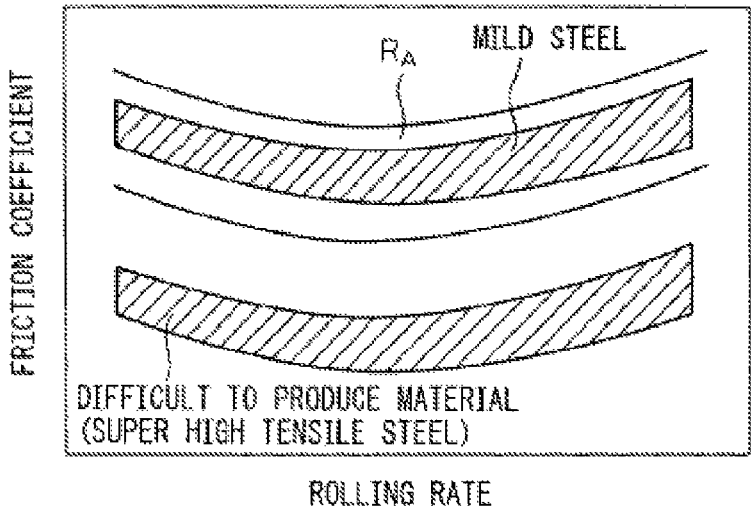
Fig.9 (Prior Art)
FIG. 9 is a graph of the relationship between the range of application RA of one type of lubrication oil A and two types of steel (mild steel and super high tensile steel) in the conventional method of supplying lubrication oil.

In this embodiment, for mild steel, the lubrication oil A is used in the entire rolling rate region. For low and medium grade high tensile steel, as shown in FIG. 8, two mixing ratios of the first mixing ratio and second mixing ratio are set in advance. The second mixing ratio should be set to any ratio in accordance with the rolled steel sheet etc. Further, one mixing ratio is selected from the two mixing ratios in accordance with the friction coefficient, and the emulsion EAD of the mixed oil MAD of the lubrication oils A and D mixed at the selected mixing ratio D is supplied to the inlet side of the rolling mill by the emulsion supplying rate used in the emulsion EA of the lubrication oil A.

Further, since the amount of oil introduced to the roll bite does not increase even if increasing the emulsion supplying rate, sometimes the friction coefficient will not fall below a certain value. FIG. 8 sets two ranges of application RAD1 and RAD2 considering this case. When the friction coefficient will not decrease even if increasing the emulsion supplying rate, the emulsion concentration is raised.

Further, when the friction coefficient will not decrease even if the emulsion concentration is increased, a second mixing ratio increasing the good lubricity lubrication oil D is used. When increasing the rolling rate from a low speed to high speed rolling, the friction coefficient is measured on-line. If the friction coefficient does not change even with an increase of the emulsion supplying rate, a second mixing ratio preset for high speed rolling is changed to. When switching the coil or otherwise returning to low speed rolling, with the second mixing ratio, the friction coefficient becomes too small and there is the risk of slip. In this case, the mixing ratio is returned to the original first mixing ratio. The mixing ratios prepared in advance need not be two types. In that case, if for example increasing the ratio of the good lubricity lubrication oil D in the order of the second mixing ratio and third mixing ratio, if the friction coefficient is large even with the second mixing ratio, the third mixing ratio is changed to. If the friction coefficient is large even with the third mixing ratio, the fourth mixing ratio is changed to.

The lubrication oil D may also be comprised of the lubrication oil A plus an additive. Additives are currently often used for controlling the friction coefficient at the time of high speed rolling. Additives are generally expensive, so in this invention, additives are not used in low speed rolling and are used in only high speed rolling. Due to this, it is possible to keep down the amount of use of the additives and reduce the rolling costs.

Note that the lubrication supplying method of the third aspect of the invention can be worked by a rolling facility as it is shown in FIG. 5 used for working the second aspect of the invention.

This invention is not limited to the above embodiment. The rolled steel sheet may be, in addition to steel, titanium, aluminum, magnesium, copper, or other metal and alloys of these metals.

The lubrication oil stored in a tank may have additives added to it in advance. As the additives, an emulsifier, extreme pressure agent, oiliness agent, or another additive may be used. When mixing two types of lubrication oil in the second aspect of the invention or the third aspect of the invention, both may be lubrication oil containing additives, both may be lubrication oil not containing additives, or just one may be a lubrication oil containing additives. Further, when mixing a lubrication oil and additives, the additives mixed with the additives mixed into the lubrication oil in advance may be same or different.

EXAMPLES

A single-stand 4Hi test mill was used to roll two coils joined to simulate ordinary cold rolling. The rolled steel sheet, lubrication oil, emulsion supplying rate, and rolling rate range were as follows.

Rolled steel sheet: Mild steel and 590 MPa high tensile steel

Lubrication Oil:

Lubrication oil A (lubrication oil containing palm oil in an amount of 35% and synthetic ester in 65% and having a viscosity at 40° C. of 39 cSt)

Lubrication oil B (lubrication oil comprised of synthetic ester in an amount of 100% and having a viscosity at 40° C. of 80 cSt)

Emulsion supplying rate: 5 liter/min

Rolling rate range: 200 to 1500 mpm (1) An emulsion of the lubrication oil A at a concentration of 5% was used to roll mild steel. As a result, rolling was possible with no problem of seizure flaws from the accelerated/decelerated region of 200 mpm to the highest speed 1500 mpm.

(2) An emulsion of the lubrication oil B at a concentration of 5% was used to roll mild steel. As a result, the friction coefficient was too small and slip occurred.

(3) An emulsion of the lubrication oil B at a concentration of 3% was used to roll mild steel. As a result, neither slip nor seizure occurred.

(4) An emulsion of the lubrication oil B at a concentration of 2.5% was used to roll mild steel. As a result, seizure flaws occurred during rolling at 1500 mpm. A look at the purchasing prices of lubrication oil A and lubrication oil B shows that the price of the lubrication oil B is 2.2 times that of the lubrication oil A, so from the results of (1) and the results of (3), it could be confirmed that with mild steel, use of the lubrication oil A is economical.

(5) An emulsion of the lubrication oil A at a concentration of 3% was used to roll 590 MPa high tensile steel. No seizure flaws occurred at 500 mpm.

(6) An emulsion of the lubrication oil B at a concentration of 3% was used to roll 590 MPa high tensile steel. As a result, no seizure flaws occurred from 200 mpm to 1500 mpm.

(7) Cost-wise, using the lubrication oil B over the entire speed region is not wise. If using the lubrication oil B over the entire speed region, there is also the danger of slip, so the inventors studied mixing the lubrication A with the lubrication oil B. The lubrication oil A and the lubrication oil B were mixed in amounts of 50% each to produce a mixed oil. An emulsion of this mixed oil in a concentration of 3% was used to roll 590 MPa high tensile steel. As a result, no seizure flaws or slip occurred from 200 mpm to 1800 mpm.

INDUSTRIAL APPLICABILITY

The method of supplying lubrication oil of the first aspect of invention comprises selecting one of two or more types of lubrication oil in accordance with the friction coefficient between a rolled steel sheet and work rolls and supplying an emulsion of the selected lubrication oil to the inlet side of a rolling stands. Therefore, it has the effects that the lubrication oil supplying apparatus becomes simple and control of lubrication becomes easy.

The method of supplying lubrication oil of the second aspect of the invention comprises mixing two or more types of lubrication oils selected from stored lubrication oils in accordance with a friction coefficient between a rolled steel sheet and work rolls or mixing at least one selected lubrication oil and at least one selected additive to obtain a mixed oil and supplying an emulsion of this mixed oil to the inlet side of the rolling mills. At this time, by preparing two or more types of mixed oils able to realize the required close friction coefficient, it is possible to obtain a mixed oil able to realize a friction coefficient closer to that required. Therefore, fine lubrication control becomes possible.

A method of supplying lubrication oil of a third aspect of the invention comprises setting in advance two mixing ratios of a first mixing ratio and second mixing ratio of two types of lubrication oil or a lubrication oil and additive in accordance with the friction coefficient, selecting one of the two mixing ratios in accordance with the estimated friction coefficient during rolling, and supplying an emulsion of the mixed oil produced by the selected mixing ratio. Due to this, even if the required friction coefficient changes in a certain range, it is possible to select a mixed oil close to the required friction coefficient. Therefore, the effect is exhibited that it is possible to control lubrication finely with a high precision.

The invention claimed is:

1. A method of supplying lubrication oil for supplying an emulsion of a lubrication oil and heated water mixed together to an inlet side of a rolling stand in cold rolling of a metal sheet, comprising storing two or more types of lubrication oils of different compositions in separate tanks, wherein said two or more types of lubrication oils comprise one lubrication oil for mild steel and one lubrication oil for high tensile strength steel, selecting one of said stored lubrication oils in accordance with a friction coefficient between the rolled metal sheet and work rolls, and supplying an emulsion comprised of said selected lubrication oil and heated water mixed together to an inlet side of the rolling stand to achieve a target friction coefficient by a method comprising first adjusting a supply rate of said emulsion, and, if adjusting said supply rate is not sufficient, further adjusting a concentration of said emulsion.

2. A method of supplying lubrication oil in cold rolling as set forth in claim 1 wherein at least one of said lubrication oil includes an additive.

3. A method of supplying lubrication oil for supplying an emulsion comprised of a lubrication oil and heated water mixed together to an inlet side of a rolling stand in cold rolling of a metal sheet, comprising storing two or more types of lubrication oil of different compositions and at least one type of lubrication oil and at least one type of additive in separate tanks, wherein said two or more types of lubrication oils comprise one lubrication oil for mild steel and one lubrication oil for high tensile strength steel, mixing two or more types of lubrication oil selected from said stored lubrication oils in accordance with the friction coefficient between the rolled metal sheet and work rolls, mixing at least one selected lubrication oil and at least one selected additive to obtain a mixed oil, and supplying an emulsion comprised of this mixed oil mixed with heated water to an inlet side of a rolling stand to achieve a target friction coefficient by a method comprising first adjusting a supply rate of said emulsion, and, if adjusting said supply rate is not sufficient, further adjusting a concentration of said emulsion.

4. A method of supplying lubrication oil in cold rolling as set forth in claim 3, further comprising controlling the emulsion lubrication oil supplying rate and/or emulsion concentration in accordance with the rolling rate.

5. A method of supplying lubrication oil in cold rolling as set forth in any of claims 1 to 2, wherein said mild steel is a steel having a tensile strength of 600 MPa or less, and said high tensile steel is a steel having a tensile strength above 600 MPa.

6. A method of supplying lubrication oil in cold rolling as set forth in any of claims 1 to 2, wherein said method of adjusting said supply rate of the emulsion and concentration of the emulsion comprises first increasing said supply rate of the emulsion and further increasing said concentration of the emulsion to reduce the friction coefficient.

7. A method of supplying lubrication oil in cold rolling as set forth in any of claims 1 to 2, further comprising measuring the friction coefficient and adjusting said supply rate and, if adjusting said supply rate is not sufficient, further adjusting a concentration of said emulsion such that the measured friction coefficient matches the target friction coefficient.

* * * * *

UNITED STATES PATENT AND TRADEMARK OFFICE

CERTIFICATE OF CORRECTION

PATENT NO. : 8,720,244 B2
APPLICATION NO. : 11/791354
DATED : May 13, 2014
INVENTOR(S) : Takahama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1906 days.

Signed and Sealed this
Twenty-ninth Day of September, 2015

Michelle K. Lee

Michelle K. Lee
*Director of the United States Patent and Trademark Office*